United States Patent [19]

Horodysky

[11] 4,389,322

[45] Jun. 21, 1983

[54] FRICTION REDUCING ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 276,129

[22] Filed: Jun. 22, 1981

Related U.S. Application Data

[63] Continuation-in-part of Ser. No. 95,005, Nov. 16, 1979, abandoned.

[51] Int. Cl.[3] ..... C10M 1/10

[52] U.S. Cl. ..... 252/49.6; 252/33.6

[58] Field of Search ..... 252/49.6, 51.5 A, 33.6, 252/49.7

[56] References Cited

U.S. PATENT DOCUMENTS

| | | | |
|---|---|---|---|
| 2,403,067 | 7/1946 | Fischer et al. | 252/51.5 A |
| 3,009,791 | 11/1961 | Emrick | 252/49.6 |
| 4,151,101 | 4/1979 | Anzenberger et al. | 252/49.6 |
| 4,176,076 | 11/1979 | Waldstein | 252/49.6 |

*Primary Examiner*—Jacqueline V. Howard

*Attorney, Agent, or Firm*—Michael G. Gilman; Charles J. Speciale; Howard M. Flournoy

[57] ABSTRACT

Ethoxylated amides and borated adducts of ethoxylated amides are effective friction reducing additives when incorporated into lubricants.

11 Claims, No Drawings

FRICTION REDUCING ADDITIVES AND COMPOSITIONS THEREOF

CROSS REFERENCE TO RELATED APPLICATIONS

This application is a continuation-in-part application of U.S. application Ser. No. 95,005 which was filed on Nov. 16, 1979 for *FRICTION REDUCING ADDITIVES AND COMPOSITIONS THEREOF*, now abandoned.

BACKGROUND OF THE INVENTION

1. Field of the Invention

This invention is directed to friction-modifying additives and to lubricant compositions containing same. This invention is further directed to a means of reducing the fuel requirements of internal combustion engines wherein the moving parts of said engines are treated with lubricants containing the ethoxylated additives disclosed herein.

2. Discussion of the Prior Art

A major concern in today's energy conscious world is how the fuel consumption requirements of internal combustion engines can be reduced. Considerable work has been done in the area of treating the moving parts of such engines with lubricant compositions containing friction-modifying additives.

Amides and amide derivatives have found widespread use as lubricating oil additives and as intermediates in the synthesis of a variety of lubricant products. It has now been found that certain ethoxylated amides possess significant friction reducing properties when incorporated into internal combustion engine oil formulations. Boration of the active hydroxyl group therein generally further improves the friction reducing properties of said oil formulations.

SUMMARY OF THE INVENTION

The ethoxylated compounds of this invention have the following generalized structure:

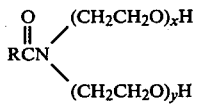

where R is a hydrocarbyl group having from about 10 to about 30 carbon atoms, R may be alkyl, alkenyl, aralkyl, alkylaryl, etc. and x and y may be the same or different and each is whole number from 1 to about 10, preferably 1 to 5 with the proviso that the sum of x and y must be at least 2 or more.

The ethoxylated amides may be conveniently obtained from commercial sources or prepared in any manner known in the art. For example, the ethoxylated amides may be prepared by the reaction of the appropriate hydrocarbyl amide with ethylene oxide, optionally in the presence of a catalyst, to form the corresponding ethoxylated amide. The ethoxylated amides may also be prepared by the reaction of a hydrocarbyl carboxylic acid with an ethoxylated amine, e.g., bis(2-hydroxyethyl) oleamide can be formed by the reaction of oleic acid and diethanol amine.

Included among the suitable ethoxylated amides are bis(2-hydroxyethyl) oleamide, and polyoxyethylene (5) hydrogenated tallowamide and similar suitable amides.

The borated derivatives may be prepared by treating the described amides with boric acid in alcoholic solvents such as butanol or pentanol, or hydrocarbon solvents such as benzene, toluene, xylene or a mixture thereof. Reaction temperatures of 70° to 250° C. can be used but 110° to 170° C. is preferred. Reaction times can be 1 to 10 hours or more. Up to a stoichiometric amount or an excess of boric acid can be used to produce a derivative containing 0.05% to 6% wt. boron. Other methods are also available to make similar bororated derivatives. For example, the ethoxylated amides may also be borated through transesterification with a trialkyl borate such as tributyl borate (often in the presence of boric acid).

Selected borated adducts of the above-described amides possess even greater friction reducing properties than non-borated amides. For example reductions in the coefficient of friction of up to 33% were observed with the use of a 2% composition of borated bis(2-hydroxyethyl) oleamide (Example 5) as compared with a non-borated product in a fully blended synthetic automotive engine oil. The boration also imparts improved oxidation stability and improved bearing corrosion inhibition characteristics to the ethoxylated amides of the present invention.

The lubricants contemplated for use herein include both mineral and synthetic hydrocarbon oils of lubricating viscosity, mixtures thereof and greases prepared therefrom or other solid lubricants. The synthetic hydrocarbon oils include long chain alkanes such as cetanes and olefin polymers. These synthetic oils can comprise or be mixed with (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from about 1 to 20 carbon atoms, or mixtures of such acids.

The amount of additive compound in the lubricant composition will usually range from about 0.1% to about 10% by weight of said lubricant, preferably from about 0.25 to about 5% by weight. Other known additives can be included in the final formulation, in amounts up to about 10 wt. %, or more, for their known purposes.

The use of additive quantities of the instant surface active amines and borated adducts thereof results in a significant reduction of friction thereby providing a method for reducing fuel consumption in an internal combustion engine by treating the moving surfaces thereof with a composition comprising a major proportion of an oil of lubricating viscosity and a minor effective friction reducing amount of the instant additive compounds.

Having described the invention in general terms, the following examples are offered to specifically illustrate the development. It is to be understood they are illustrations only and that the invention is not thereby limited except as by the appended claims.

DESCRIPTION OF SPECIFIC EMBODIMENTS

Certain ethoxylated and polyethoxylated amides and their borated derivatives in accordance with the present invention and prepared as described below or obtained commercially were blended into a fully formulated 5W-20 automotive engine oil lubricant and evaluated using the Low Velocity Friction Apparatus (LVFA).

EXAMPLE 1

Base blend: The fully formulated 5W-20 automotive engine oil contained a dispersant/detergent/inhibitor package and had the following general properties:

Kinematic Viscosity
100° C.-6.8 cs
40° C.-36.9 cs
Viscosity Index
143

EXAMPLE 2

Bis(2-hydroxyethyl) oleamide was prepared as follows: Approximately 565 g of oleic acid and 210 g diethanolamine was charged to a stirred 2 liter glass reactor. Approximately 100 g of toluene solvent was added and the mixture was heated up to 145° C. over a period of about 7 hours. A total of approximately 41 g of water was removed by azeotropic distillation. The solvent was removed by distillation under reduced pressure. The product contained:

3.9% Nitrogen
71.8% Carbon
11.4% Hydrogen
12.3% Oxygen
0.2% Oleic acid

EXAMPLE 3

Bis(2-hydroxyethyl) oleamide was prepared as in Example 2 and thereafter treated with boric acid as follows: Approximately 185 g of the product of Example 2 was charged to 500 ml. stirred reactor with 23 g boric acid and 46 g butanol solvent. The reaction mixture was heated to 190° C. for a total of about 6 hours until the evolution of water from the reaction mixture ended. The solvent was removed by vacuum distillation and the product was filtered through diatomaceous earth to form a clear orange viscous liquid. The product contained:

3.6% Nitrogen
70.4% Carbon
10.9% Hydrogen

EXAMPLE 4

Bis(2-hydroxyethyl) oleamide (obtained commercially); a solid having a viscosity of 140 cps @ 60° C. and a specific gravity of 0.937 @ 60° C.

EXAMPLE 5

Bis(2-hydroxyethyl) oleamide was treated with boric acid. Approximately 502 g of bis(2-hydroxyethyl) oleamide described in Example 4 was charged to a 2 liter reactor with 56 g boric acid, 30 g butanol and 70 g toluene as solvents. The reaction mixture was heated up to 155° C. for a total of about 5 hours until water evolution from the reaction stopped. The solvents were removed by vacuum distillation and the crude product was filtered over diatomaceous earth to yield a clear viscous orange liquid. The product contained:

3.8% Nitrogen
68.8% Carbon
11.3% Hydrogen
1.4% Boron

EXAMPLE 6

Borated polyoxyethylene (5) hydrogenated tallowamide was prepared as follows: Approximately 442 g of polyoxyethylene (5) hydrogenated tallowamide with the following characteristics was charged to a 2 liter reactor:

Hydroxyl Number = 100
Free amide = <15%
Specific Gravity = 1.03

The material was a waxy solid containing 5 moles of ethylene oxide. Also charged to the reactor were 20 g boric acid, 10 g butanol and 75 g toluene. The reaction mixture was heated, with agitation, up to 150° C. for a total of about 4 hours until water evolution from the reaction stopped. The solvents were removed by vacuum distillation and the crude product was filtered over diatomaceous earth.

EXAMPLE 7

Polyoxyethylene (5) oleamide (obtained commercially); a liquid having 5 moles of ethylene oxide and Hydroxyl Number = 110
Free amide = <15%
Specific Gravity = 1.00

EXAMPLE 8

Borated polyoxyethylene (5) oleamide. Approximately 204 g of the product described in Example 7, 8 g boric acid and 48 g butanol were charged to a 500 ml. glass reactor. The reaction mixture was heated up to 150° C. over a period of 5½ hours until the water evolved during the reaction stopped. The product was an almost odorless viscous orange liquid.

EVALUATION OF THE PRODUCT

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in$^2$). Both surfaces are submerged in the test lubricant. Friction between the steel surfaces is measured as a function of the sliding speed at a lubricant temperature of 250° F. The friction between the rubbing surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 30 fpm sliding speed. Freshly polished steel specimens are used for each run. The surface of the steel is parallel ground to 4 to 8 microinches.

The test data are shown in the Table below. The base oil is a lubricating oil as described above. The percentages by weight are percentages by weight of the total lubricating oil composition, including the usual additive package. Thus, the corresponding value for the oil alone would be zero for the form of the data used. The data are percent decrease in friction according to:

$$\frac{U_k \text{ of oil alone} - U_k \text{ of additive} + \text{oil} \times 100}{U_k \text{ of oil alone}}$$

| Exmple No. | | Additive Conc. In Test Oil Wt. % | Percent Change in Coefficient of Friction 5 Ft./Min. | 30 Ft./Min. |
|---|---|---|---|---|
| 1. | Base, Blend, SAE 5W-20 lube oil | — | 0 | 0 |
| 2. | Bis(2-hydroxyethyl) oleamide made by reaction of oleic acid and diethanolamine | 4 | 22 | 14 |
| 3. | Borated bis(2-hydroxyethyl) oleamide | 4 | 29 | 17 |
| | Item 2 treted with boric acid | 2 | 26 | 13 |
| 4. | Bis(2-hydroxyethyl) oleamide purchased | 4 | — | 24 |
| 5. | Borated bis(2-hydroxyethyl) oleamide | 2 | 33 | 29 |
| | Item 4 treated with boric acid | 1 | 22 | 21 |
| 6. | Borated polyoxyethylene (5) hydrogenated tallowamide | 0.5 | 12 | 10 |
| 7. | Polyoxyethylene (5) oleamide, purchased | 0.5 | 13 | 12 |
| 8. | Borated polyoxyethylene (5) oleamide | 0.25 | 20 | — |

Examination of the test data reveals significant reductions in the coefficient of friction with as stated supra some of the borated derivatives being more effective at lower concentrations than the non-borated ethoxylated amides. The use of low concentrations of these friction-modifying additives in accordance herewith also improves the fuel economy characteristics of engines treated with lubricants containing same. The non-metallic compositions described in this development are not only useful at low concentrations but also do not contain any potentially undesirable phosphorus, sulfur or metallic salts; the amides and the borated derivatives are non-corrosive to copper. The ethoxylated amides as stated hereinabove are readily available commercially and/or are also readily synthesized, if necessary. The use of the highly effective fuel efficient additives of the present invention is a great potential aid in efforts to reduce fuel dependency on sources outside the borders of the United States.

While this invention has been described with reference to preferred embodiments, it will be understood by those skilled in the art, that departure therefrom can be readily made and is within the scope of the specification.

I claim:

1. A lubricant composition comprising a major proportion of an oil of lubricating viscosity or grease or solid lubricant prepared therefrom and a minor friction reducing proportion of an additive compound selected from borated adducts of N-ethoxylated amides having the following generalized structure:

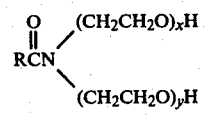

wherein R is hydrocarbyl containing 10–40 carbon atoms selected from alkyl, alkenyl, aralkyl or alkaryl, x and y are whole numbers from 1 to about 10 and where x and y may be the same or different with the proviso that x plus y must be at least 2 or more.

2. The composition of claim 1 wherein the additive compound is borated bis(2-hydroxyethyl) oleamide.

3. The composition of claim 1 wherein the additive compound is borated polyoxyethylene (5) hydrogenated tallowamide.

4. The composition of claim 1 wherein the additive compound is borated polyoxyethylene (5) oleamide.

5. The composition of claim 1 having from about 0.1 to about 10 wt. % of the additive compound.

6. The composition of claim 5 having from about 0.25 to about 4 wt. % of the additive compound.

7. The composition of claim 1 wherein the oil of lubricating viscosity is a mineral or synthetic oil or mixtures thereof.

8. The composition of claim 7 wherein said oil is a mineral oil.

9. The composition of claim 7 wherein said oil is a synthetic oil.

10. The composition of claim 1 comprising a grease or solid lubricant prepared from an oil of lubricating viscosity.

11. A method for reducing fuel consumption in an internal combustion engine by treating the moving surfaces thereof with a composition comprising a major amount of an oil of lubricating viscosity containing a minor friction reducing or fuel reducing amount of an additive compound as described in claim 1.

* * * * *

UNITED STATES PATENT AND TRADEMARK OFFICE

CERTIFICATE OF CORRECTION

PATENT NO. : 4,389,322

DATED : June 21, 1983

INVENTOR(S) : Andrew G. Horodysky

It is certified that error appears in the above—identified patent and that said Letters Patent is hereby corrected as shown below:

On columns 5 and 6 of the Table, line 21, insert --2-- and --15-- in the first two columns of figures.

On columns 5 and 6 of the Table, line 26, insert --2--, --22-- and

--17-- in the columns of figures.

Signed and Sealed this

*Eleventh* Day of *October 1983*

[SEAL]

*Attest:*

GERALD J. MOSSINGHOFF

*Attesting Officer*

*Commissioner of Patents and Trademarks*